United States Patent [19]

Deussen

[11] 4,134,511

[45] Jan. 16, 1979

[54] CONTAINER WITH FRANGIBLE SEAL

[75] Inventor: Werner Deussen, Eltville, Germany

[73] Assignee: Stella KG Werner Deussen, Walluf, Germany

[21] Appl. No.: 821,969

[22] Filed: Aug. 4, 1977

[30] Foreign Application Priority Data

Nov. 27, 1976 [DE] Fed. Rep. of Germany ..... 2653993

[51] Int. Cl.[2] ..... B65D 17/24

[52] U.S. Cl. ..... 215/32

[58] Field of Search ..... 215/32; 222/541

[56] References Cited

U.S. PATENT DOCUMENTS

| | | | |
|---|---|---|---|
| 2,750,068 | 6/1956 | Platt | 222/541 X |
| 2,814,420 | 11/1957 | Elder | 222/541 X |
| 3,460,724 | 8/1969 | Chmela | 222/541 |
| 3,749,271 | 7/1973 | Ellis | 215/32 |
| 3,777,949 | 12/1973 | Chiquiari-Arias | 222/541 |
| 3,804,282 | 4/1974 | Komendowski | 215/32 |
| 3,841,537 | 10/1974 | Marg | 222/541 |

*Primary Examiner*—Donald F. Norton

*Attorney, Agent, or Firm*—Karl F. Ross

[57] ABSTRACT

A nonrefillable container for medication and other liquid, pasty or granulated products to be kept sterile has a body of flexible resinous material, such as polyethylene or polypropylene, with a neck terminating in a solid tip which is integrally connected therewith via a reduced wall portion forming a frangible annular link whose rupture creates an outlet for the contents. The neck is surrounded in an airtight manner by a protective cap forming a socket firmly gripping the tip, the socket and the tip being of mating noncircular cross-section whereby rotation of the cap facilitates rupture of the link and withdrawal of the cap with the tip attached thereto. The cap and the neck may have complementary annular formations which interengage when, after break-off of the tip, the neck is pushed deeper into the cap than theretofore. To insure a tight initial fit free from contamination, the cap and the container are concurrently produced by injection molding and are assembled in a sterile environment while still hot from the mold.

8 Claims, 8 Drawing Figures

CONTAINER WITH FRANGIBLE SEAL

FIELD OF THE INVENTION

My present invention relates to a nonrefillable disposable container in which medication or other dispensible products of liquid, pasty or granular consistency are sealed against the atmosphere and thus kept sterile before being used.

BACKGROUND OF THE INVENTION

Conventional containers of this character, usually made of plastic material, have a hollow body which is sealed after filling but has a neck with a tab which exposes an outlet for its contents upon being pulled off. If the container is emptied only in part, the neck can be covered with a separately supplied closure cap, preferably after a temporary plugging of the outlet with a wad of cotton; see, in this connection, German printed specification No. 1,965,761. It has also been proposed (see German published application No. 24 46 564) to make the cap integral with the free end of a frangible neck extension which after rupture can thus be inverted to close the outlet.

In all these instances, the container surface surrounding the tab or frangible neck extension is unprotected and therefore subject to contamination by handling and by exposure to the atmosphere; the interior of the closure cap is similarly exposed. Thus, sterility of the product subsequently poured from the outlet cannot be assured unless the container and the cap, after sterilization, are hermetically sealed in an external wrapper which, of course, adds to the cost of the item.

Another problem is that the outlet created by the forcible break-off of a frangible neck extension generally has an irregular and often jagged boundary which is not only unsightly but also potentially dangerous.

A further drawback of conventional disposable containers of flexible plastic material is that the finger pressure required to hold the container body during exposure of the outlet tends to squeeze out some of its contents at the instant of rupture, thus causing spillage of the product on the skin or the garments of the user.

OBJECTS OF THE INVENTION

The important object of my present invention, therefore, is to provide a container of the character described which obviates the aforestated disadvantages.

SUMMARY OF THE INVENTION

In accordance with my present invention, a sealed hollow container body has an extremity (referred to hereinafter as a neck) provided with an elongate solid projection or tip which is integrally connected thereto via a reduced wall portion forming a frangible annular link whose rupture creates an outlet for the product stored in the container. The neck is closely surrounded, in an airtight manner, by a protective cap which firmly engages that tip and cannot be detached from the container body until the tip has been broken off.

The close fit of the cap around the neck prevents the entry of germs and other contaminants into the region around the tip so that joint removal of the cap and the tip exposes a previously untouched container surface surrounding the newly formed outlet. Furthermore, the presence of the cap during storage and transportation of the sealed container protects its tip against premature rupture even if the link connecting the tip to the container body is rather frail. Thus, the link may be constituted by a very thin wall portion of the container neck (e.g. a fraction of a millimeter thick) whose severance leaves a clean break.

According to a further feature of my invention, the tip is received with press fit in a socket of the protective cap for rotatable entrainment, relative to the container body, about the neck axis. Thus, the tip and the socket may have mating noncircular cross-sections through which the user can exert upon the connecting link a torque greater than that which could be applied to it if the tip were directly gripped with the fingers.

In order to insure that the neck portion embraced by the cap is unsoiled at the time of assembly, the interfitting of the neck and the cap should take place under noncontaminating conditions. Such assembly, therefore, is advantageously carried out in a sterile environment when the container body and the cap, concurrently produced by injection molding, are both still hot from the mold and therefore do not carry any germs. The container and the cap are preferably molded from the same or similar elastomeric resins such as polyethylene or polypropylene.

In the case of a disposable single-dose container, whose contents are to be used only once, the cap serves only the aforedescribed purposes of preventing contamination and simplifying the rupture of the tip. If, on the other hand, the container is to be emptied in successive stages, the cap may also be used to reclose the outlet between discharges. Upon re-use, the container neck can be pushed more deeply into the cap for reclosure to provide a tighter seal, provided that the bottom of the cap formed with the socket is initially separated from a confronting end wall of the neck carrying the tip. Advantageously, the container neck and the cap are provided with mutually complementary annular peripheral formations such as a ridge and a groove which interengage when the cap is thus repositioned, thereby preventing its accidental dislodgement.

According to another advantageous feature of my invention, the frangible tip is attached to the end wall of the container neck not directly but with interposition of a tubular section acting as a nipple or spout when the tip is subsequently broken off. The presence of such a nipple is particularly useful with eye, ear or nose drops as well as with other medications to be applied rectally or vaginally, for example.

BRIEF DESCRIPTION OF THE DRAWING

The above and other features of my invention will now be described in detail with reference to the accompanying drawing in which.

SPECIFIC DESCRIPTION

Figure 1:
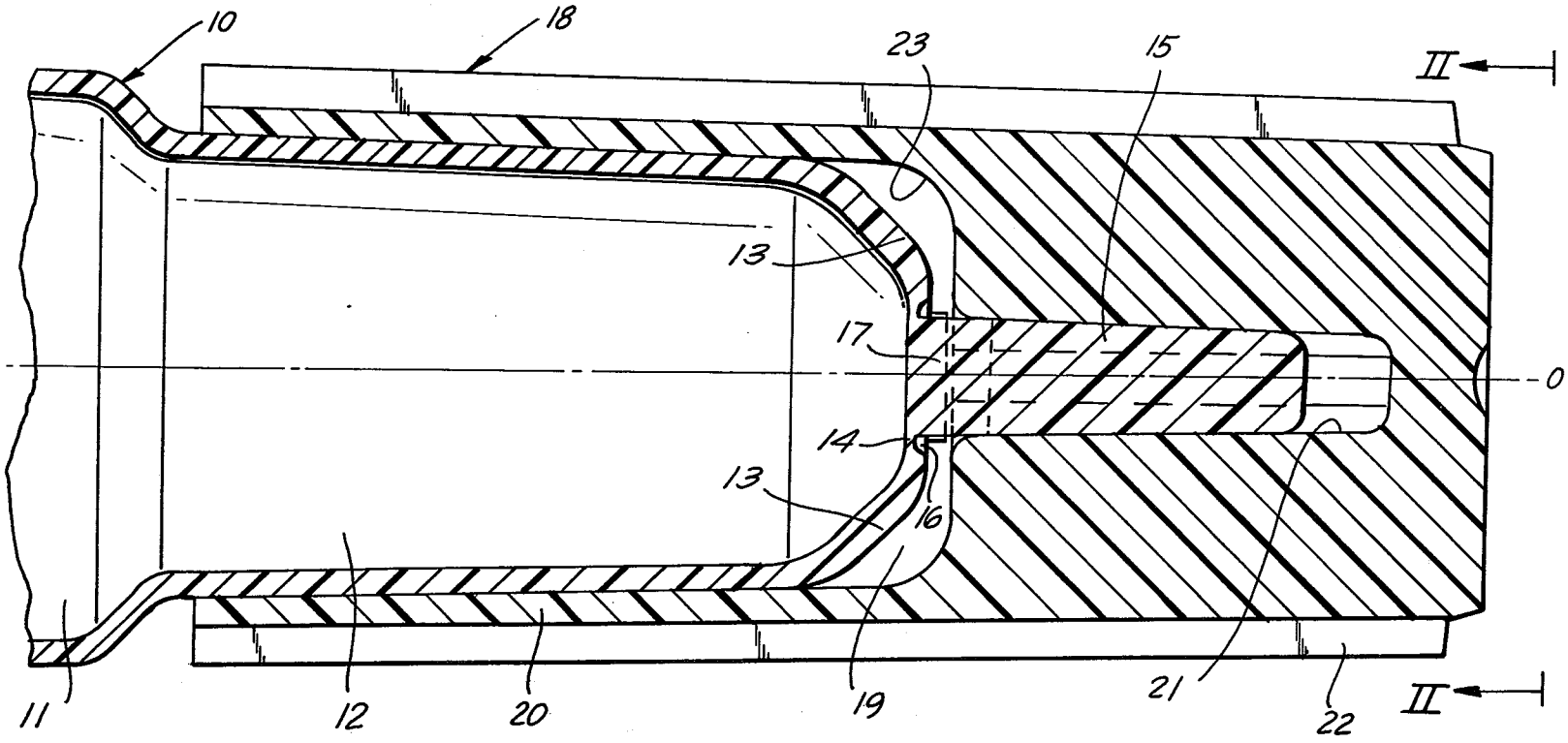
FIG. 1 is a fragmentary sectional view of a container according to my invention, showing the container neck provided with a protective cap.
Figure 2:
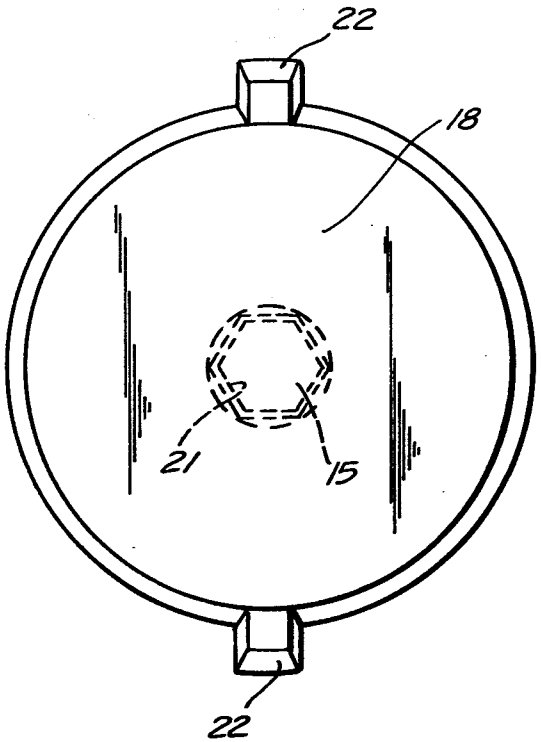
FIG. 2 is an end view of the cap as seen on the line II — II of FIG. 1.
Figure 6:
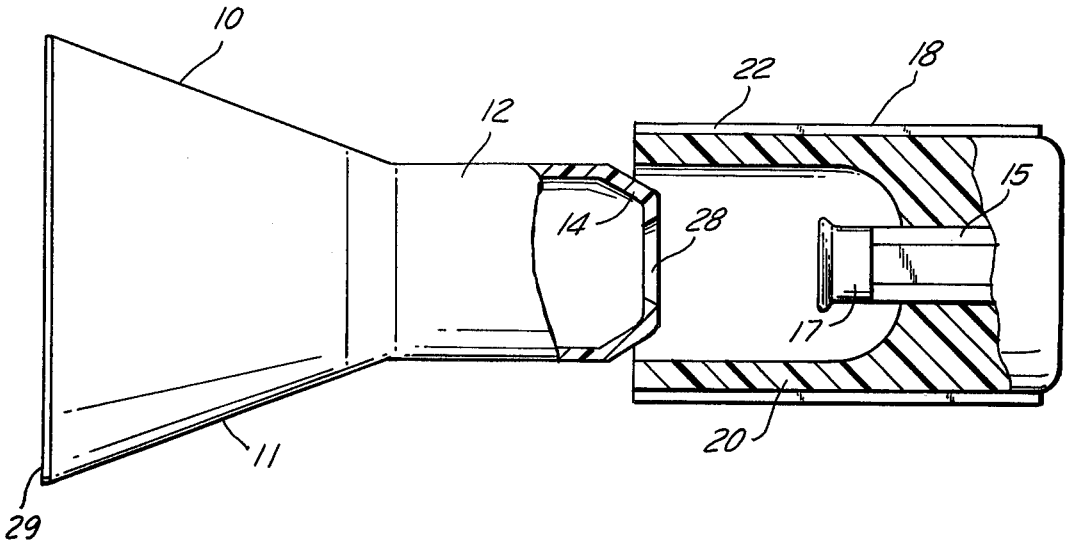
FIG. 6 is a partly sectional view, drawn to a smaller scale of the container and the cap of FIG. 1 separated from each other.

In FIGS. 1 and 2 I have shown a container 10 comprising a hollow body 11 having a reduced neck 12. The opposite end of container body 11, not shown in FIG. 1 but seen in FIG. 6, is pinched closed by a sealing strip 29 after the container has been filled with a medicament or some other product in liquid, pasty or granular form.

A generally hemispherical end wall 13 of neck 12, centered on an axis 0, has an annular depression 16 surrounding a solid tip 15 integral with the container body. Tip 15 has a circularly cylindrical portion 17 close to neck 12 but is of polygonal (i.e. hexagonal) cross-section over the greater part of its length as seen in FIGS. 2 and 6. Tip 15 is received with a press fit in a correspondingly profiled socket 21 of a protective cap 18 whose peripheral wall 20 closely surrounds the neck 12 in airtight fashion. The contact surfaces of neck 12 and wall 20 as well as those of tip 15 and socket 21 are slightly tapered in a direction away from container body 11, thereby limiting the extent to which the neck can be inserted into the cap. Thus, the wall 13 is held separated by an axial clearance 19 from the confronting cap bottom 23. The cap 18 cannot be detached from the neck 12 by an axial pull as long as tip 15 remains intact.

Figure 3A:
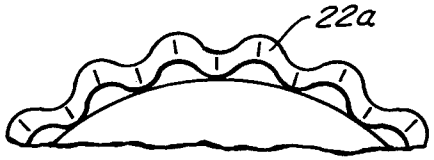
FIGS. 3*a* and 3*b* are partial end views of a modified cap.
Figure 3B:
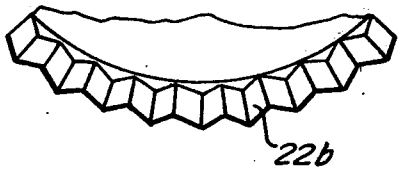

The part of wall 13 weakened by the depression 16 constitutes a rupturable link 14 along which the tip 15 is severed from the neck 12 upon relative rotation of the container 10 and the cap 18 about their common axis 0. To facilitate such relative rotation, I prefer to provide the cap 18 with external gripping formations such as ribs 22 (FIGS. 1 and 2), undulations 22*a* (FIG. 3*a*) or serrations 22*b* (FIG. 3*b*). The outer edge of depression 16 diverges from axis 0 at an angle of about 30° to form a transition zone turning into a smooth boundary for a central outlet 28 which comes into existence when the tip is twisted off; only then can the cap be separated from the container, together with the tip 15, as shown in FIG. 6.

The container and the cap are molded from resinous, preferably elastomeric material such as polypropylene. In order to insure that the area 13, 14 of neck 12 surrounding the tip 15 is free from contaminants when the container and the cap are interfitted, it is advantageous to produce both by injection-molding in an environment of sterilized air under a pressure slightly higher than atmospheric and to assemble them promptly after ejection from the mold, while they are still hot and therefore absolutely germfree.

Figure 7:
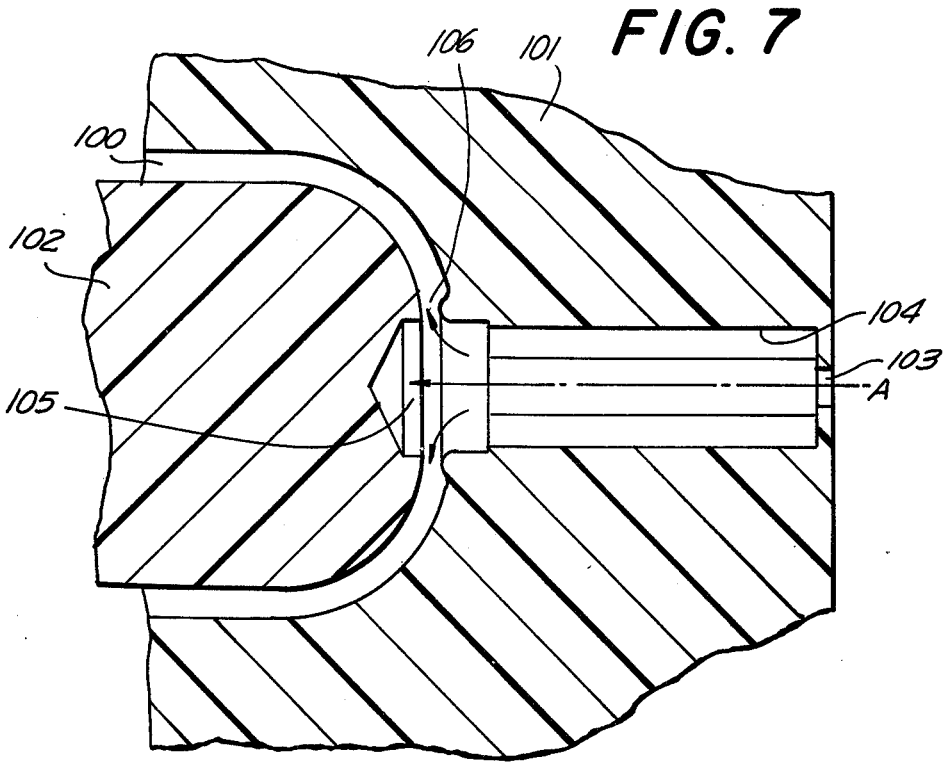
FIG. 7 is a schematic cross-sectional view of an injection mold designed to produce a container according to my invention.

Certain precautions should be observed in the molding of a container of the type illustrated in FIG. 1 whose wall thickness at the frangible link is very small (e.g. only a few tenths of a millimeter). Since even a minor eccentricity of a mold cavity defined by two separate members, namely the mold proper and a core, tends to be magnified upon the injection of the fluid thermoplastic material, holes or cracks could develop at that point unless the core is precisely centered relatively to the mold. I have found that such centering is facilitated if, as illustrated in FIG. 7, the container is formed in a cavity 100 between a mold 101 and a core 102 with central injection of the mass through a gate 103 into a channel 104 conforming to the tip 15 of the container, this tip thus serving as a large-diameter hot runner. A recess 105 in core 102, aligned with channel 104, receives the so-called cold slug in the initial stage of injection (arrow A); after the channel 104 fills up, the injected mass spreads out laterally through a surrounding annular constriction 106 (designed to form a reduced wall portion 16) acting as a fan gate, the thermoplastic material thereupon passing into the cavity 100 in an essentially laminar flow to form the container body 11 and its neck 12. Extraction of the finished container from the mold cavity is facilitated by the aforedescribed taper of its body including the neck and the tip. Recess 105, whose presence helps maintain the coaxial orientation of mold 101 and core 102, results in the formation of an inward extension of tip 15 which has no functional significance in the finished article and has not been illustrated in FIGS. 1 and 6. The socket 21 of the concurrently molded cap 18 should be so dimensioned as to provide the desired forced fit when shrinking around the tip 15 upon final cooling after assembly.

Figure 4:
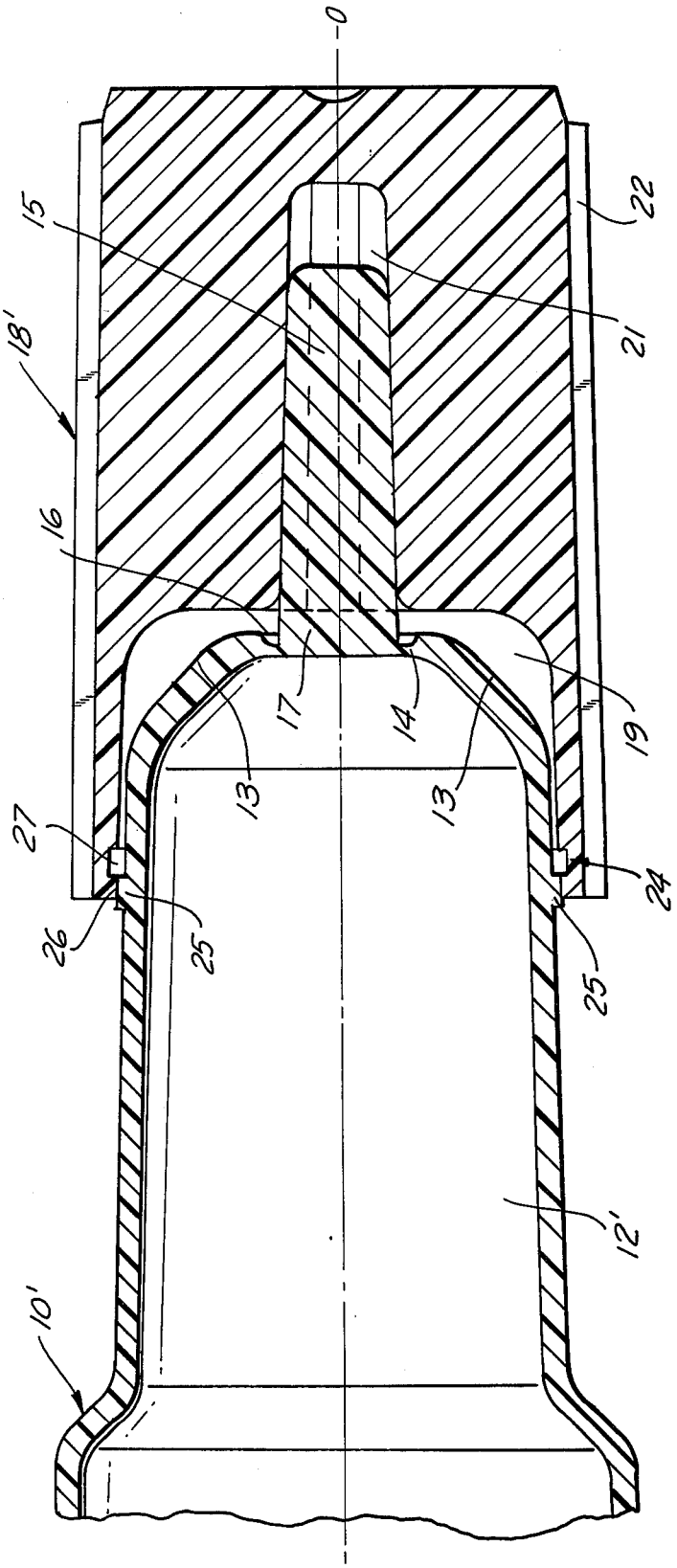
FIG. 4 is a fragmentary sectional view similar to FIG. 1, illustrating other modifications.

In FIG. 4 I have shown a container 10′ and a cap 18′ differing from their counterparts in FIG. 1 by being provided with a detent, generally designated 24, comprising an annular rib 25 on container neck 12′ initially in contact with an internal annular shoulder 26 at the rim of cap 18′. An annular groove 27 on the inner cap surface, immediately behind shoulder 26, accommodates the rib 25 when the cap is pushed further onto the neck even as the cylindrical end 17 of the twisted-off tip 15 enters the outlet 28 (FIG. 6). Rib 25 snaps into groove 27 when the end wall of neck 12′ contacts the bottom of cap 18′ so that outlet 28 plugged by the tip 15 is also peripherally sealed to prevent leakage of the contents to the outside; detent 24 acts as a further barrier against such leakage as well as against the intrusion of ambient air and dirt. A slight bevel of the edges of rib 25 and groove 27 enables disengagement of the cap 18′ from the neck 12′.

If desired, the rib 25 could be so positioned with reference to the groove 27 as to engage in that groove already upon initial assembly. The clearance 19 may then be correspondingly narrowed so that the wall 14 contacts the cap bottom in that position of engagement, especially if the container is not to be emptied at once.

Figure 5:
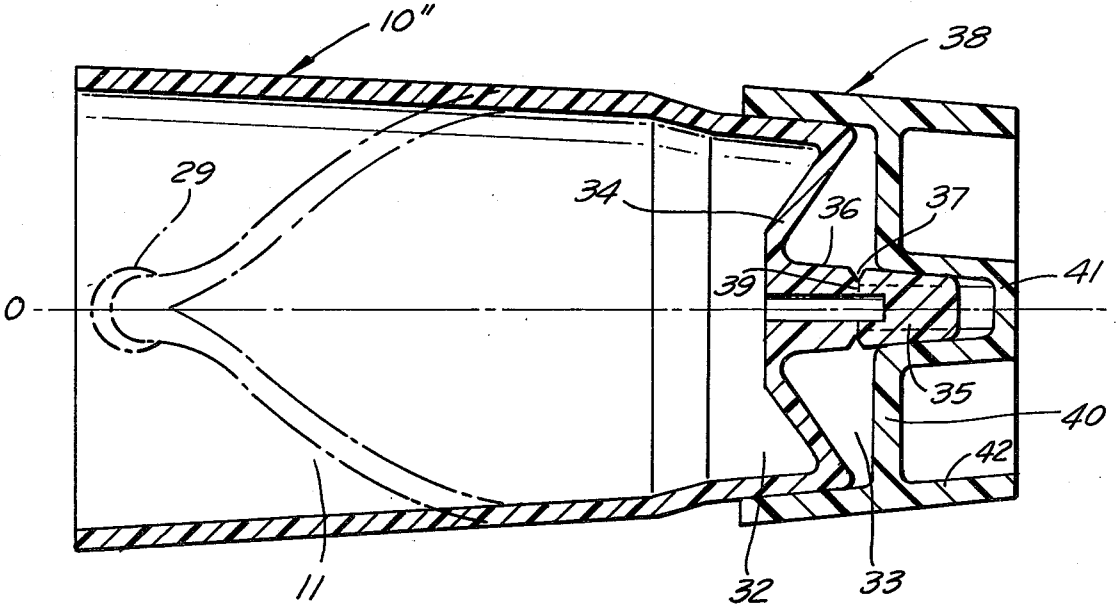
FIG. 5 is a longitudinal sectional view of a container and cap constituting a further embodiment.

A container 10″, shown in FIG. 5, differs from containers 10 and 10′ of the preceding FIGURES by having its neck 32 formed with a frustoconically re-entrant end wall 34 that is axially extended into a tubular section 36 aligned with a tip 35 from which it is separated by an annular depression 37 defining a rupturable link or break-off point 39. A coacting cap 38 has a bottom 40 with a thimble-shaped boss 41 forming a socket for the tip 35, the socket and the tip being again advantageously provided with mating polygonal or otherwise noncircular cross-sections for positive rotary coupling. When the tip 35 is twisted off at the depression 37, by relative rotation of the cap and the container body as described above, tubular section 36 forms a nipple or spout for the dropwise administration of medication to not readily accessible parts of a patient's anatomy, for example; pressure exerted through the flexible container wall upon the stored substance then deforms the end wall 34 to extend the nipple 36 outwardly. The clearance 33 initially separating the wall 34 from the cap bottom 40 allows the peripheral wall 42 of the cap 38 to be pushed further up the container neck 32 upon reclosure, the axially re-entrant configuration of wall 34 allowing the tubular section 36 to be thrust inwardly by the tip 35 during this operation. Section 36 and tip 35 are frustoconical and frustopyramidal, respectively, with common generatrices. Neck 32 and peripheral wall 42 could, of course, be provided with detent formations such as the rib 25 and the groove 27 of FIG. 4.

A re-entrant end wall 34 as shown in FIG. 5 could also be used in lieu of the generally hemispherical end wall 13 of container 10 or 10', FIGS. 1 and 4, in combination with a tip 15 linked to the container neck by way of a surrounding wall portion 14 of reduced thickness. Thus, a container with a convex end wall 13 can be used as a direct applicator of medication to a wound, for instance, whereas one with a concave end wall 34 (without nipple 36) may serve as a distributor of powder, for example, over a larger skin area.

FIG. 5 also shows, in phantom lines, the sealing of the opposite (left-hand) end of the container body after it has been filled, again with the aid of a strip 29.

Conventional techniques, such as the use of multipartite molds and/or collapsible cores, are available for producing the containers 10' and 10'' together with the asssociated caps by an injection-molding process generally similar to that described with reference to FIG. 6.

I claim:

1. A nonrefillable container for dispensable products to be stored under sterile conditions, comprising:

a sealed hollow body having an extremity centered on an axis with an end wall and a solid axially extending projection on said end wall integrally connected therewith via a frangible link whose rupture creates an outlet for the contents of said body; and a protective cap surrounding said extremity in close contact therewith, said cap having a bottom separated by an axial clearance from said end wall and formed with a socket receiving said projection in mating engagement therewith, said cap being inseparable from said body without rupture of said link, said cap and said extremity being provided with mutually complementary annular formations axially offset from each other and interengageable with a snap fit upon a repositioning of said cap on said extremity after a separation therefrom and detachment of said projection to permit a partial discharge of said contents by way of said outlet, said bottom coming to rest against said end wall and forming a seal around said outlet upon interengagement of said formations.

2. A container as defined in claim 1 wherein said formations are a groove near the rim of said cap and a rib on said extremity overlain by said rim.

3. A container as defined in claim 1 wherein said projection and said socket are positively coupled for joint rotation about a common axis.

4. A container as defined in claim 3 wherein said projection and said socket have mating noncircular cross-sections.

5. A container as defined in claim 3 wherein said cap is provided with external formations facilitating rotation thereof relative to said extremity.

6. A container as defined in claim 1 wherein said projection, said socket and contact surfaces of said extremity and said cap are tapered in a direction away from said body.

7. A container as defined in claim 1 wherein said end wall is generally hemispherically convex.

8. A container as defined in claim 1 wherein said body and said cap consist of elastomeric material.

* * * * *